US006104888A

United States Patent [19]

Kobayashi

[11] Patent Number: 6,104,888

[45] Date of Patent: Aug. 15, 2000

[54] SYSTEM FOR DETERMINING A CHARACTERISTIC OF AN IMAGE FORMING UNIT DETACHABLY MOUNTED IN AN IMAGE FORMING APPARATUS

[75] Inventor: Fuminori Kobayashi, Aichi-ken, Japan

[73] Assignee: Minolta Co., Ltd., Osaka, Japan

[21] Appl. No.: 09/189,766

[22] Filed: Nov. 10, 1998

[30] Foreign Application Priority Data

Nov. 12, 1997 [JP] Japan ..... 9-310291

[51] Int. Cl.[7] ..... G03G 15/00

[52] U.S. Cl. ..... 399/12

[58] Field of Search ..... 399/12, 13, 25, 399/31

[56] References Cited

U.S. PATENT DOCUMENTS

| | | | |
|---|---|---|---|
| 5,021,828 | 6/1991 | Yamaguchi et al. . | |
| 5,043,764 | 8/1991 | Arnold et al. | 399/59 |
| 5,214,481 | 5/1993 | Hoover | 399/335 |
| 5,699,091 | 12/1997 | Bullock et al. | 347/19 |
| 5,710,956 | 1/1998 | Kurohata et al. | 399/24 |
| 5,835,817 | 11/1998 | Bullock et al. | 399/25 |

FOREIGN PATENT DOCUMENTS 5-040373 2/1993 Japan .

*Primary Examiner*—Robert Beatty
*Attorney, Agent, or Firm*—McDermott, Will & Emery

[57] ABSTRACT

A unit detector 100 includes a main circuit 72 in an image forming device and a complementary circuit 74 in a image forming unit detachably mounted in the image forming device. The complementary circuit 74 has a fuse RF and a first resistor R1, connected in parallel to each other. The main circuit 72 includes a power supply 78, a first circuit portion 82 having a second resistor R2 which is connected through the complementary circuit 74 to the power supply 78 when the unit is properly mounted in the image forming device, and a second circuit portion 84 connected in parallel with the second resistor R2 and having third resistor R4 and switch Tr connected in serial with the resistor R4. The main circuit 72 further includes a detector 88 for detecting a voltage or a current at a portion of the first circuit portion 82. Also mounted in the main circuit 72 is a fusing circuit portion element for closing the switch for a predetermined time for blowing the fuse when it is determined that the fuse has not been blown from the voltage or current detected by the detector 88.

15 Claims, 14 Drawing Sheets

10
38
36
16
14
26
20
12
34
64
62
U2
28
58
50
56
24
40
U1
22
18
48
30
32
42

SYSTEM FOR DETERMINING A CHARACTERISTIC OF AN IMAGE FORMING UNIT DETACHABLY MOUNTED IN AN IMAGE FORMING APPARATUS

FIELD OF THE INVENTION

The present invention relates to a system for determining a characteristic of an image forming unit detachably mounted in an image forming apparatus. Further, the present invention relates to a system for determining whether an image forming unit detachably mounted in the image forming apparatus is new.

BACKGROUND OF THE INVENTION

In a typical electrophotographic image forming device, such as copy machine and printer, now available in the market, a developer, a photosensitive member, or both are constructed in or as a disposable unit. Such unit, if it has reached a predetermined service life (e.g., it has been used for a predetermined service time or a predetermined number of printing or copying processes), should be replaced by a new one of the same type. For this purpose, the image forming apparatus needs not only a function for determining how long its has been used but also a function for determining whether a new unit is mounted in image forming device. Another function is needed for determining whether the unit is properly mounted in the image forming device.

To meet such requirements, U.S. Pat. No. 5,021,828 discloses a unit detector which includes not only a device for detecting whether the disposable unit mounted in the image apparatus is new but also a device for detecting whether the unit is properly mounted in the image forming apparatus.

The unit detector, however, uses two independent devices for respective purposes. This requires a number of components and then a balky space for accommodating such two devices.

SUMMARY OF THE INVENTION

Accordingly, a primary object of the present invention is to provide a system of simple construction for detecting whether the mounted unit is new and for detecting whether the unit is properly mounted in the image forming device, with a reduced number of components and a minimum space.

Therefore, a detecting system of the present invention is used in an image forming apparatus. The image forming apparatus is detachably provided with a unit that cooperates with the image forming apparatus in an image formation of the image forming apparatus. The detecting system detects whether the detachable unit is properly mounted in the image forming apparatus. In particular, the detecting system includes a complementary circuit mounted in the detachable unit. The complementary circuit includes a fuse and a first resistor, connected in parallel. A main circuit is mounted in the image forming apparatus. The main circuit has a power source and a first circuit portion. The first circuit portion includes a second resistor which is connected with the power source through the first circuit portion when the unit is mounted in the image forming apparatus. The main circuit further includes a second circuit portion, connected in parallel with the second resistor, having a third resistor and a switch connected in serial with the third resistor. A detector is provided for detecting a voltage or a current in a portion of the first circuit portion. A third circuit portion is also provided for closing the switch to blow the fuse in response to the voltage or current detected by the detector.

With the detecting system of the present invention, where the detachable unit is not mounted in the image forming apparatus, the first circuit portion of the main circuit is disconnected from the power supply, which results in that no current flows in the first circuit portion. The detector detects this condition. Therefore, using a detection result of the detector, it can be determined that no unit is mounted in the image forming apparatus.

Once the unit is mounted in the image forming apparatus, the power supply is connected with the first circuit portion in the main circuit through the complementary circuit in the unit, which allows the current to flow in the first circuit portion. In this instance, the detector detects a certain voltage or current at the certain portion of the first circuit.

If the mounted unit is new, the fuse in the complementary unit is alive at this moment. Therefore, when the new unit is mounted in the image forming apparatus, in the main circuit the current flows through the first resistor and the fuse in the complementary circuit, which is detected by the detector. Further, with the detection of the detector, it can be determined that the mounted unit is new.

When it is determined that the mounted unit is new, the third circuit closes the switch, which results in that an excessive current flows to blow the fuse. The blowing of the fuse will decrease the resistance of the complementary circuit. This varies the voltage or current at the certain portion in the first circuit, which is detected by the detector. Thereby, the main circuit recognizes that the unit in which the fuse has been blown is no longer new. Then, the image forming apparatus performs subsequent processes under the recognition that the unit is not new. Also, even after the blowing of the fuse, the image forming apparatus can determine whether the unit is mounted in the apparatus based upon the detection performed by the detector because the detected value of the voltage or current will change by the mounting of the unit in the image forming apparatus.

Accordingly, with the detection system of the present invention, simply by arranging one component (i.e., main circuit), it can be determined whether the mounted unit is new and whether the unit is properly mounted in the image forming apparatus. This reduces the number of parts of the unit detecting system, resulting in the small-sized system.

In another aspect of the present invention, a plurality of units are prepared for the image forming apparatus. In each unit, the first resistor has a specific resistance which is different from that in other unit. The main circuit further includes means for determining whether which unit is mounted in the image forming apparatus.

With this embodiment, the image forming apparatus can determine that which type of unit is now mounted therein.

The features and advantages of the present invention will become apparent to those skilled in the art after review of the following detailed description of the preferred embodiment and the accompanying drawings.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS

Figure 1:
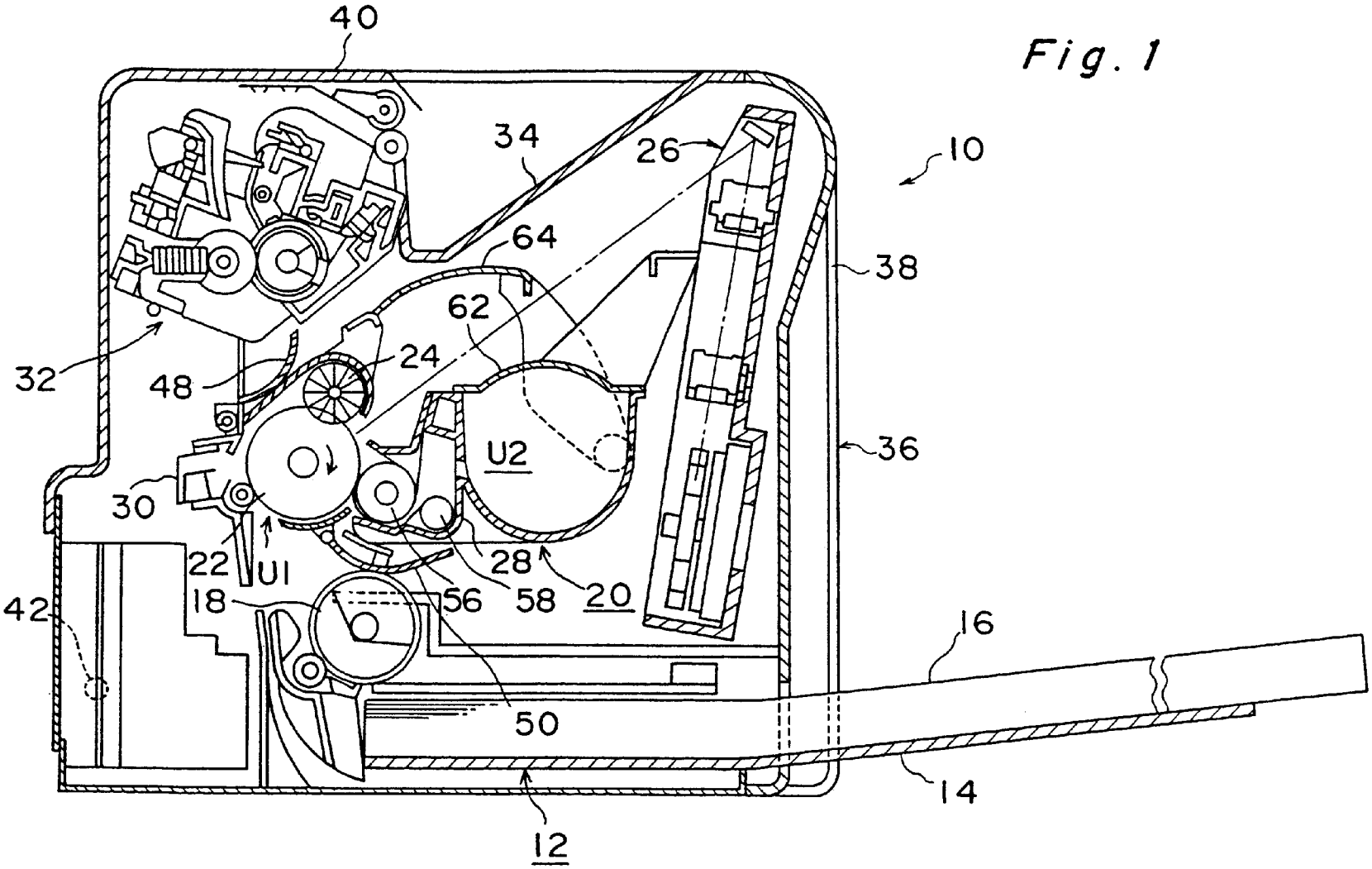
FIG. 1 is a cross sectional view of a laser printer having a fixed frame portion and a removable frame portion, in which the present invention is applied.

With reference to the drawings, a preferred embodiment of the present invention will be described hereinafter. Referring first to FIG. 1, there is shown a photoelectric laser printer, generally indicated by reference numeral 10. The printer 10 has a sheet feeding station 12 in which a sheet cassette 14 is detachably mounted for receiving a stack of sheets 16. The sheet feeding station 12 further includes a sheet feed roller 18 mounted for rotation to contact with the uppermost sheet 16 in the cassette 14, allowing each sheet 16 to be fed sequentially to an image forming station 20.

The image forming station 20 includes an electrostatic latent image bearing member or photosensitive drum 22 for reproducing an image on the sheet 16 through a well-known electrophotography. Mounted around the photosensitive drum 22 are a charging device having a brush 24, for example, for charging an outer periphery of the photosensitive drum 22, a laser projecting device 26 for projecting a laser beam onto the charged photosensitive drum 22 and thereby forming a corresponding latent image thereon, a developing device 28 for developing the latent image into a visualized image with a developer material or toner, and a transferring device 30 for transferring the visualized image onto the sheet 16. The printer 10 further includes a fixing device 32 for permanently fixing the transferred image on the sheet 16 and a discharge tray 34 to which the sheet 16 bearing the fixed toner image is discharged.

In this printer 10, particularly, the photosensitive drum 22 and the charging device 24 are integrated into a single unit (hereinafter referred to as "photosensitive-drum unit U1", if necessary) and the developing device 28 is constructed as another single unit (hereinafter referred to as "developer unit U2", if necessary). The units U1 and U2 are independently detachable from the printer 10, allowing the sheet jammed in its transportation pass to be easily removed therefrom.

Figure 2:
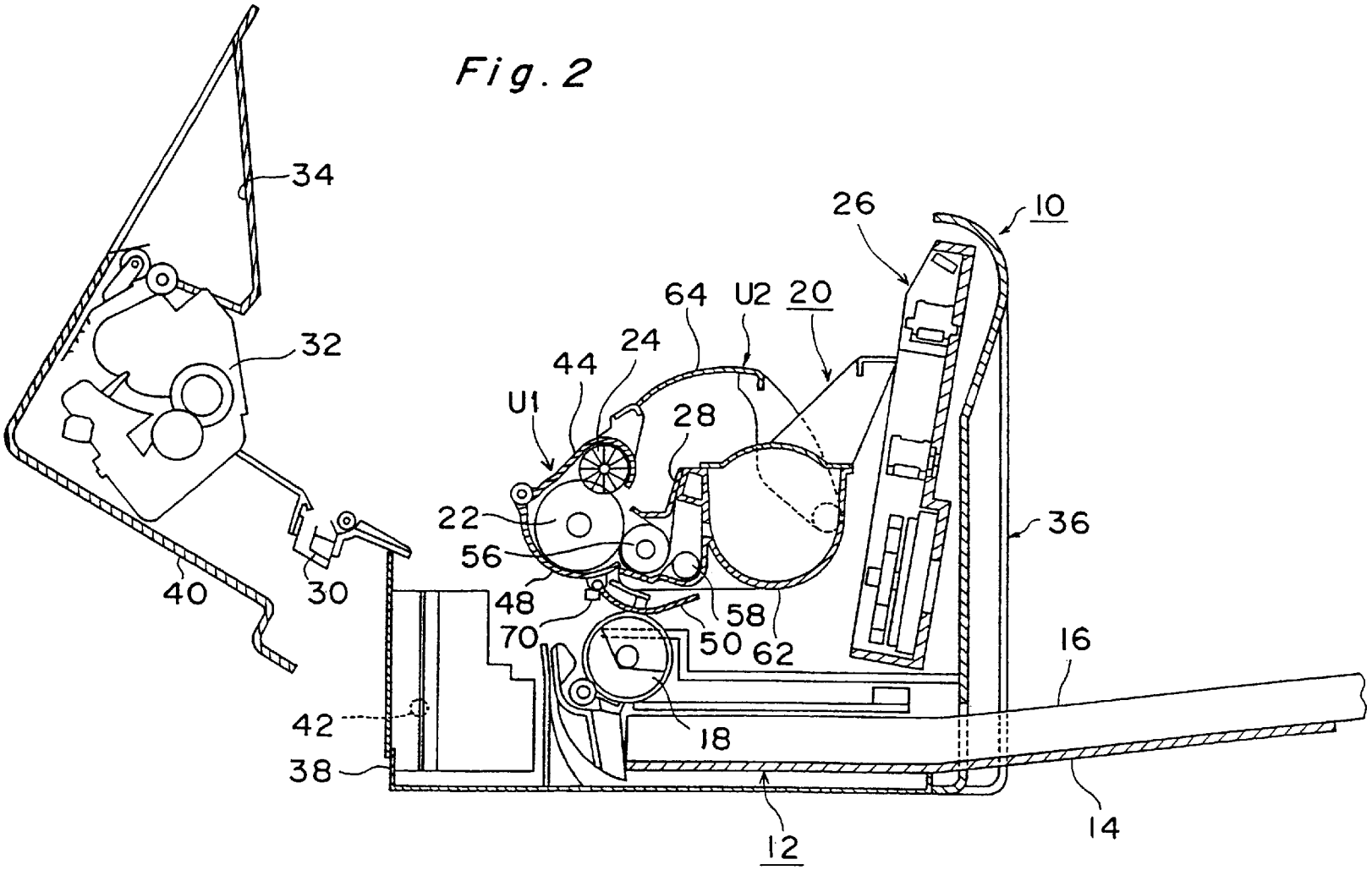
FIG. 2 is a cross sectional view of the laser printer in FIG. 1, in which the removable frame portion is in an opened position.

Referring to FIGS. 1 and 2, the printer 10 has a holder or frame 36 which is formed with a fixed lower frame portion 38 surrounding a lower portion of the printer 10 and a releasable upper frame portion 40 surrounding an upper portion of the printer 10. The releasable upper frame portion 40 is connected at a hinge 42 with the lower frame portion 38, such that it can move between a closed position (shown in FIG. 1) where it closes an upper opening of the lower frame portion 38 and an opened position (shown in FIG. 2) where it opens the upper opening of the lower frame portion. The units U1 and U2 are located adjacent to the upper opening of the lower frame portion 38 so that each of which units can be removed from the lower frame portion 38 provided that the upper frame portion 40 is in the opened position.

In addition, the lower frame portion 38 includes the sheet feed station 12 and laser projecting device 26. The upper frame portion 40, on the other hand, includes the transferring device 30 and fixing device 32 and is integrally formed with the discharge tray 34.

Figure 3:
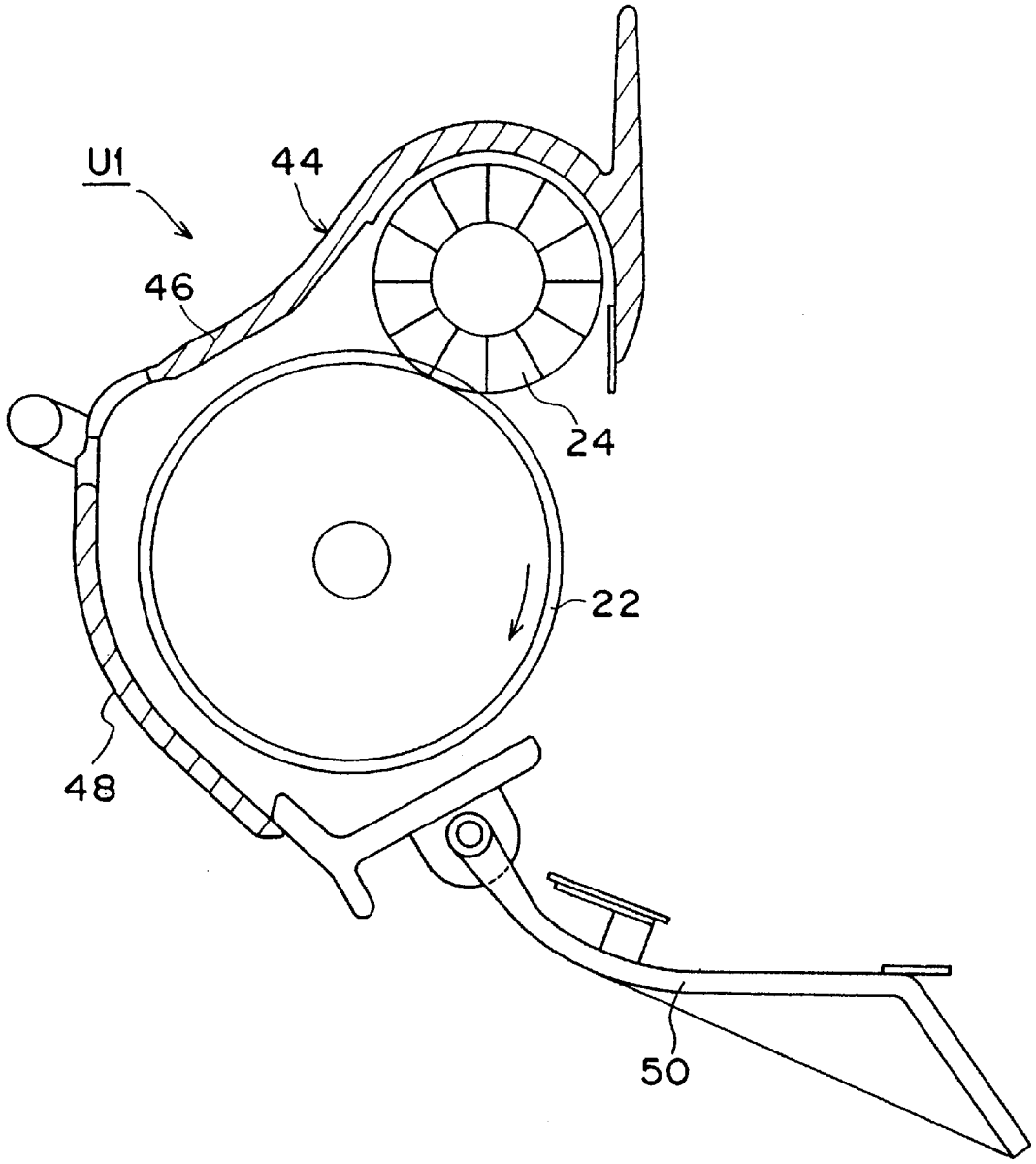
FIG. 3 is a cross sectional view of a photosensitive-drum unit in which a second shutter is in an opened position.
Figure 4:
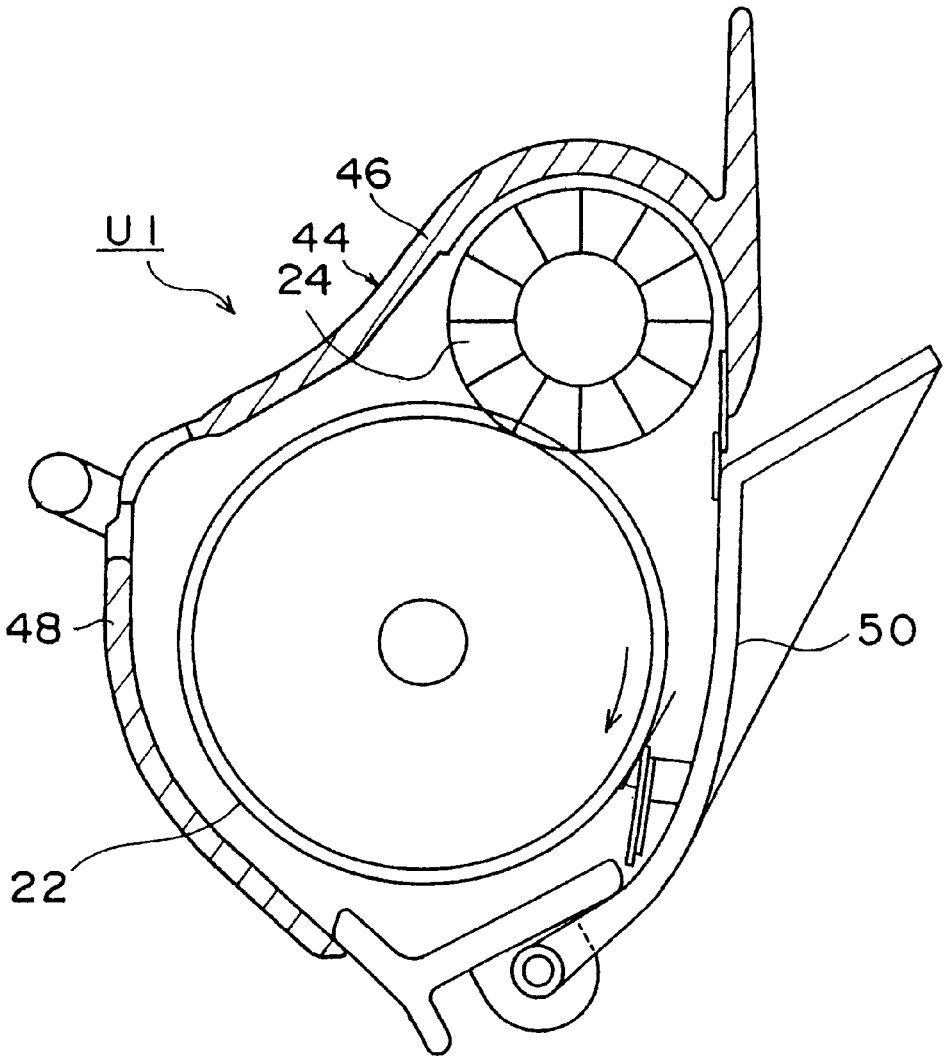
FIG. 4 is a cross sectional view of the photosensitive-drum unit in which the second shutter is in a closed position.

Referring now to FIGS. 3 and 4, the photosensitive-drum unit U1 has a casing 44 in which the photosensitive drum 22 and the charging device 24 are accommodated. The casing 44 has a body 46 formed with openings which faces the developing device 28 and the transferring device 30, respectively. The openings are closed with removable shutters 48 and 50, respectively. The shutters 48 and 50 closes the openings when the unit U1 is removed out of the lower frame portion 38, but opens to expose the photosensitive drum 22 to both the developing device 28 and the transferring device 30 when the unit is properly mounted in the lower frame portion 38.

Figure 6:
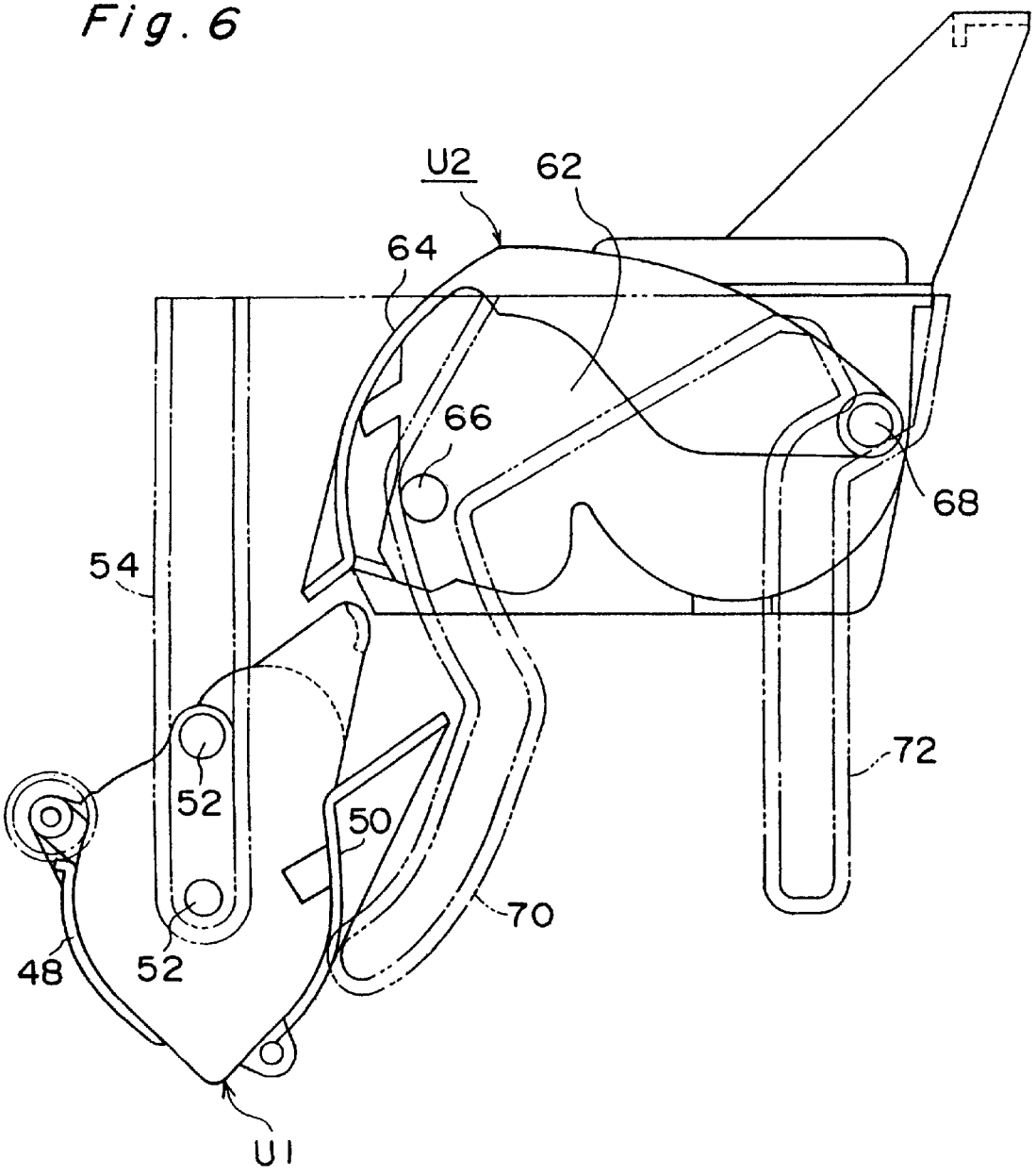
FIGS. 6 to 8 are schematic diagrams showing and describing a mounting of the developer unit and a mechanism for opening shutters of the photosensitive-drum and developer units and, in FIG. 6 the developer unit is out of engagement with the photosensitive-drum unit and the shutters remain closed, in FIG. 7 the developer unit is being engagement with the photosensitive-drum unit and thereby the shutters are in the process of opening, and in FIG. 8 the developer unit is properly mounted in position in the image forming device and the shutters are full opened
Figure 7:
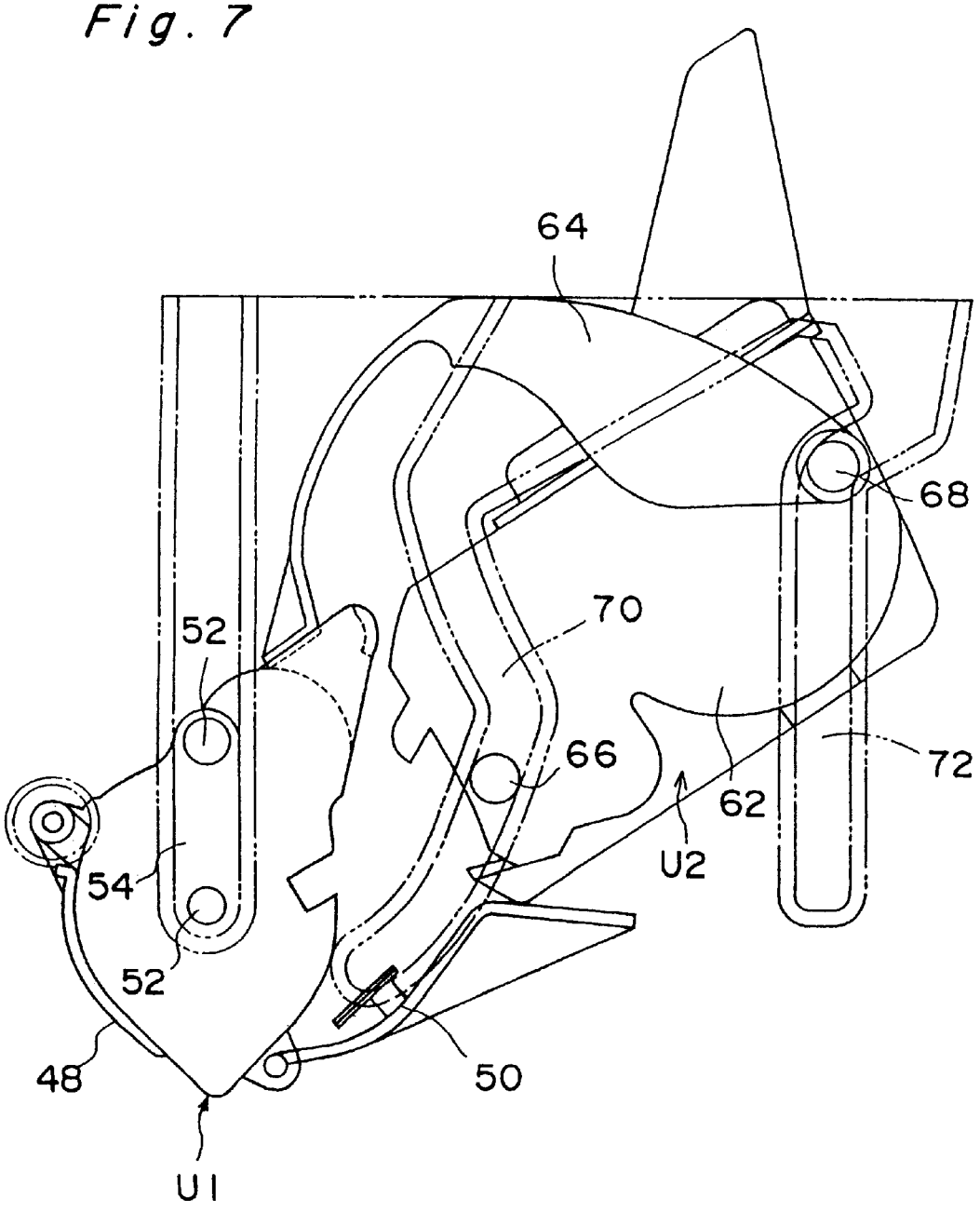
Figure 8:
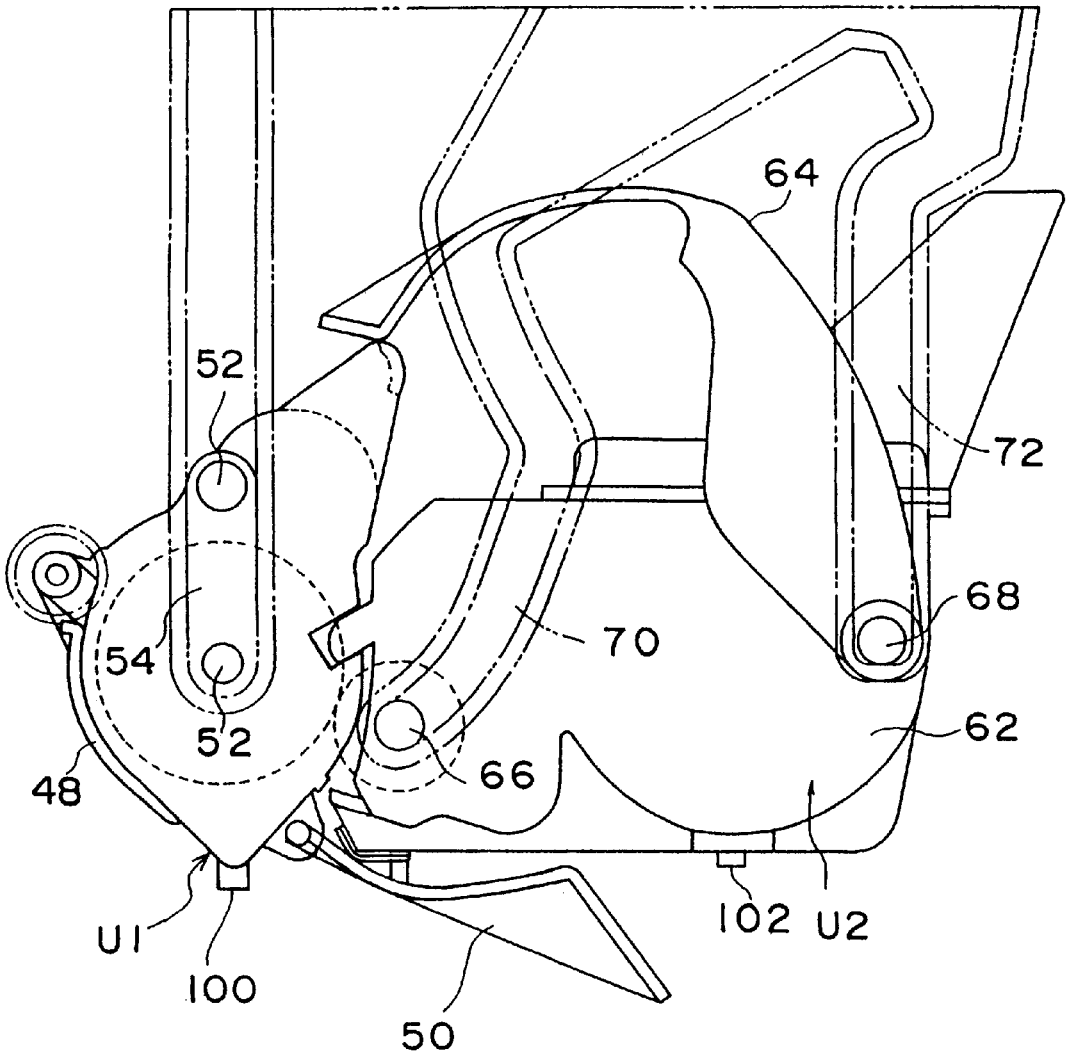

To allow the unit U1 to be mounted easily in the lower frame portion 38, as shown in FIGS. 6, 7 and 8, the casing 44 of the unit U1 has a pair of projections 52 projected outwardly from its opposite end walls extending substantially parallel to the sheet transporting direction. The fixed frame portion 38, on the other hand, has a pair of grooves 54 (for clarity only one of which is shown in the drawings) in its side walls each opposing to the end walls of the unit U1. This allows the unit U1 to be mounted in a predetermined position of the lower frame 38 simply by sliding and moving the projections 52 along the corresponding grooves 54.

The units U1 and U2 are so designed that a portion of the developer unit U2 makes an engagement in its mounting process with a corresponding portion of the photosensitive-drum unit U1 already mounted properly in the lower frame portion 38. This causes the shutter 50 of the photosensitive-drum unit U1 to move its opened position (see FIGS. 1 and 2), allowing the photosensitive drum 22 to directly meet the developing device 28.

Also, the photosensitive-drum unit U1 and the upper frame portion 40 are so designed that portions thereof will make an engagement in the process of closing the upper frame portion 40 over the lower frame portion 38, so that the shutter 48 is displaced to its opened position. This causes the photosensitive drum 22 to directly face the transferring device 30.

Figure 5:
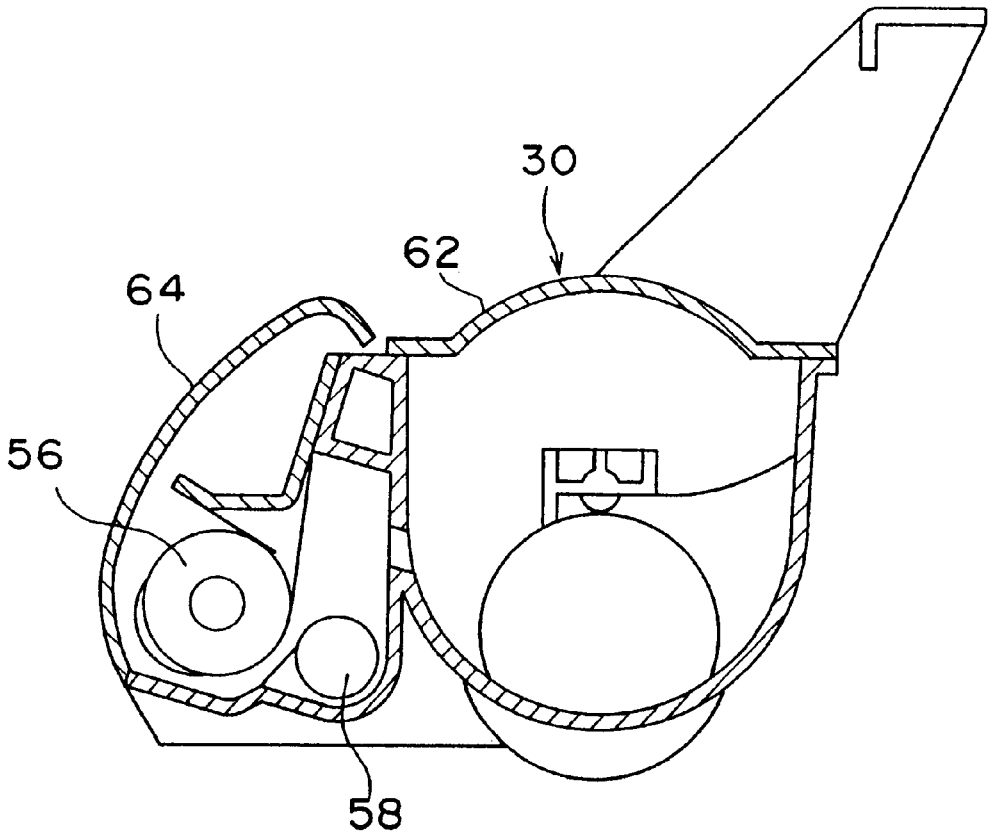
FIG. 5 is a cross sectional view of a developer unit.

Referring to FIGS. 1, 2 and 5, the developer unit U2 includes a developer roller 56 for providing the developer material to the electrostatic latent image on the photosensitive drum 22 and thereby developing the electrostatic latent image into the visible image. The developer unit U2 further includes a supply roller 58 for supplying the toner particles to the developer roller 56. The developer roller 56 and the supply roller 58 are accommodated in a casing 62 together with the developer material.

The casing 62 has an opening which faces to the developer roller 56 when the unit U2 is properly mounted in the lower frame portion 38. Also provided with the casing 62 is a shutter 64 which moves between a closed position where it closes the opening (see FIG. 5) and an opened position where it opens the opening (see FIGS. 1 and 2).

To allow the unit U2 to be easily mounted in the lower frame portion 38, the casing 62 has two pairs of projections 66 and 68, each set of projections 66 and 68 are formed in the end walls extending substantially parallel to the sheet transporting direction. For clarity, only one set of projections 66 and 68 are shown in FIGS. 6, 7 and 8. The lower frame portion 38 has guide grooves 70 and 72 in opposite sidewalls for the projections 66 and 68, respectively. This ensures the unit U2 to be guided and mounted properly in the lower frame portion 38 simply by sliding the projections 66 and 68 along corresponding grooves 70 and 72. In addition, the shutter 64 and the unit U1 are so designed that, on condition that the unit U1 is already set in position in the lower frame portion 38, the shutter makes a contact with the set unit U1 as the unit U2 moves into the lower frame portion 38, allowing the developer roller 56 to face the photosensitive drum 22.

Figure 9:
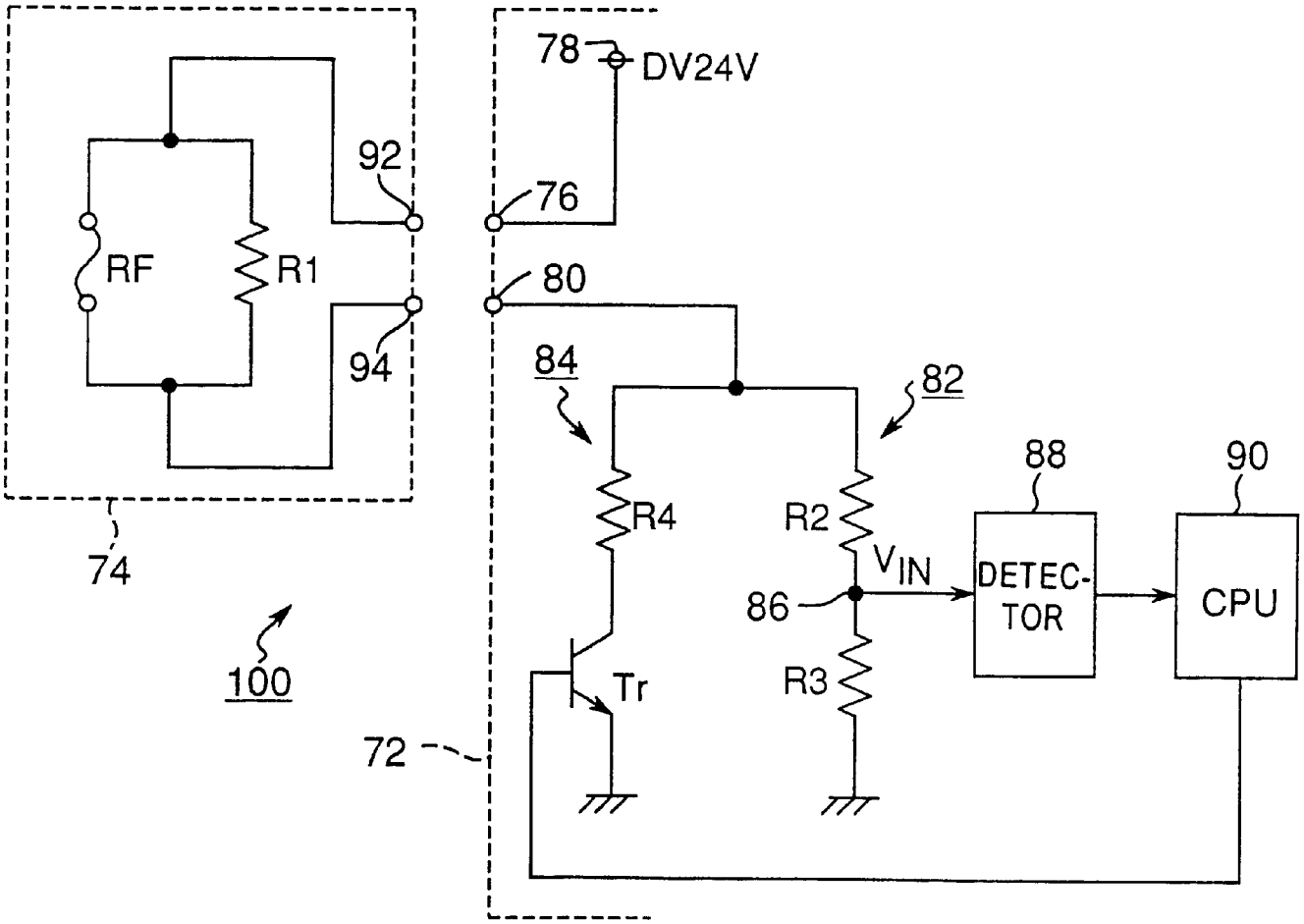
FIG. 9 is a diagram of a unit detecting circuit in which a main circuit in the image forming device is disconnected from a complementary circuit in the unit.

Referring to FIG. 8, the printer 10 is provided with two detectors 100 and 102. Each of the detectors 100 and 102 are used to detect whether the associated unit is properly mounted in the lower frame portion 38 and to detect whether the mounted unit is new. As shown in FIG. 9, each of the detectors 100 and 102 includes a main circuit 72 provided in the lower frame portion 38 and a complementary circuit 74 provided in the unit. The circuit portions 72 and 74 for the unit U1 is substantially identical to that of the other unit U2. Therefore, a common letter "U" will be used for the units U1 and U2 in the following description, if required.

Figure 10:
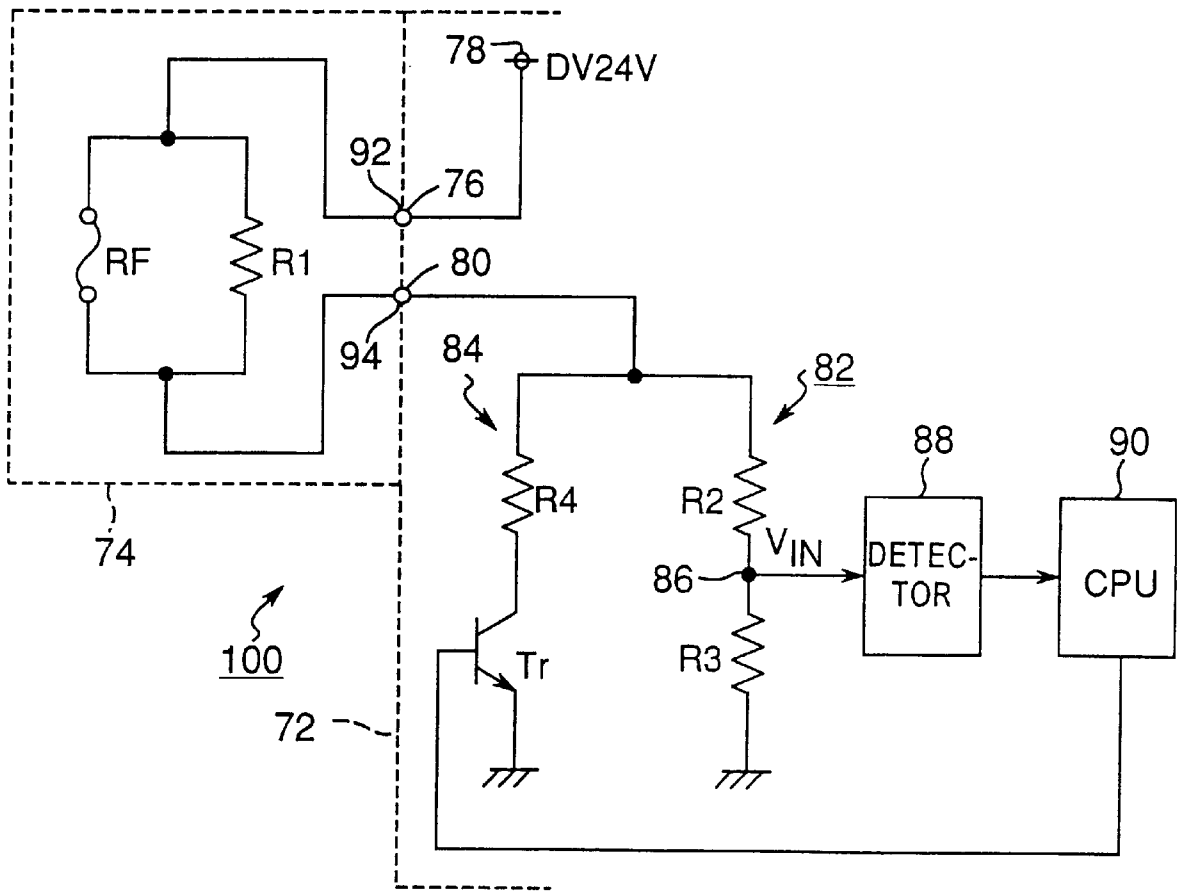
FIG. 10 is a diagram of the unit detecting circuit in which the main and the associated circuit portions are connected.

Referring to FIG. 10, the main circuit 72 has terminals 76 and 80. The terminal 76 is connected with a power source 78 (for example, DC 24 volts). The other terminal 80 is connected with two circuit elements 82 and 84 arranged in parallel. The circuit element 82 includes a serially connected two resistors R2 and R3. The other circuit element 84 includes a resistor R4 and a switching device or transistor Tr, connected in serial. A node 86 positioned between the resistors R2 and R3 is connected with a voltmeter 88 to measure a voltage of the node 86. The voltmeter 88 is connected with a controller 90 for transmitting the voltage measurement to the controller 90. The controller 90 is connected with the transistor Tr so that, according to a signal from the controller, the transistor Tr can be switched on and off.

The complementary circuit 74 of the unit U has a pair of terminals 92 and 94 connected to each other through a resistor R1 and a fuse RF, arranged in parallel. The terminals 92 and 94 are designed so that, once the unit U is mounted in position in the lower frame portion 38, they make electric contacts with corresponding terminals 76 and 80, respectively With the above-described arrangement, where the unit U is out of the lower frame portion 38, as shown in FIG. 9, the main and the complementary circuits 72 and 74 are disconnected from each other. In this instance, no electric current flows through the resistors R2 and R3, and therefore the voltage $V_{IN}$ at the node 86, detected by the voltmeter 88, remains zero. Once the unit U is mounted in position in the lower frame portion 38, as shown in FIG. 10, the terminals 76 and 80 in the circuit portion 72 are connected with corresponding terminals 92 and 94 of the complementary circuit 74. This causes the electric current to flow through the resistors R1, R2 and R3 and the fuse RF. Then, the transistor Tr is switched on by a trigger signal transmitted from the controller 90, allowing the electric current to flow into the resistor R4.

Discussions will be made to controls performed in the controller 90. Among others, the controller 90 performs two major controls. One control is to determine whether the unit U is mounted in position in the lower frame portion 38. The other control is to determine whether the mounted unit is new; that is, whether the unit is mounted for the first time after its manufacturing and, if so, eliminate an indication or characteristic which indicates that the unit is new. In this embodiment, the fuse RF is used for the indication, which would be blown when the unit is first mounted in the lower frame portion 38.

Figure 12:
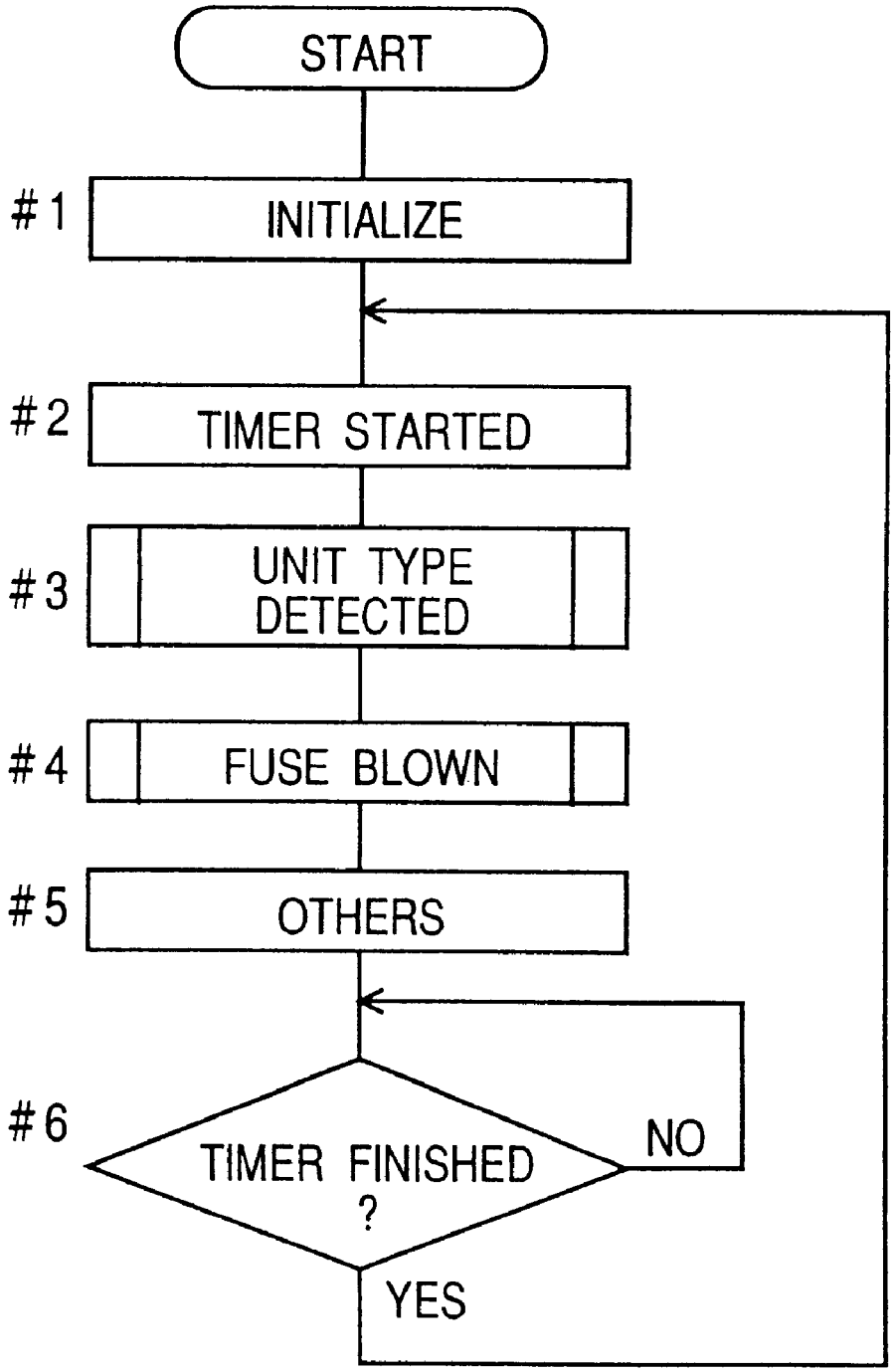
FIG. 12 is a main flowchart of a process performed by a controller of the unit detecting circuit.

Assume that a new unit U is first mounted in the lower frame portion 38. The electric connection at that moment is shown in FIG. 10 and a corresponding control program performed in the controller 90 is illustrated in FIG. 12.

With this program, the controller 90 initializes a microprocessor at step #1, starts an inner timer at step #2, determines the unit mounted at step #3, blows the fuse RF at step #4 and performs other tasks at step #5. Then, the controller 90 determines whether the inner timer has finished at step #6 and, if so, returns to step #2 to restart the initial timer.

Figure 13:
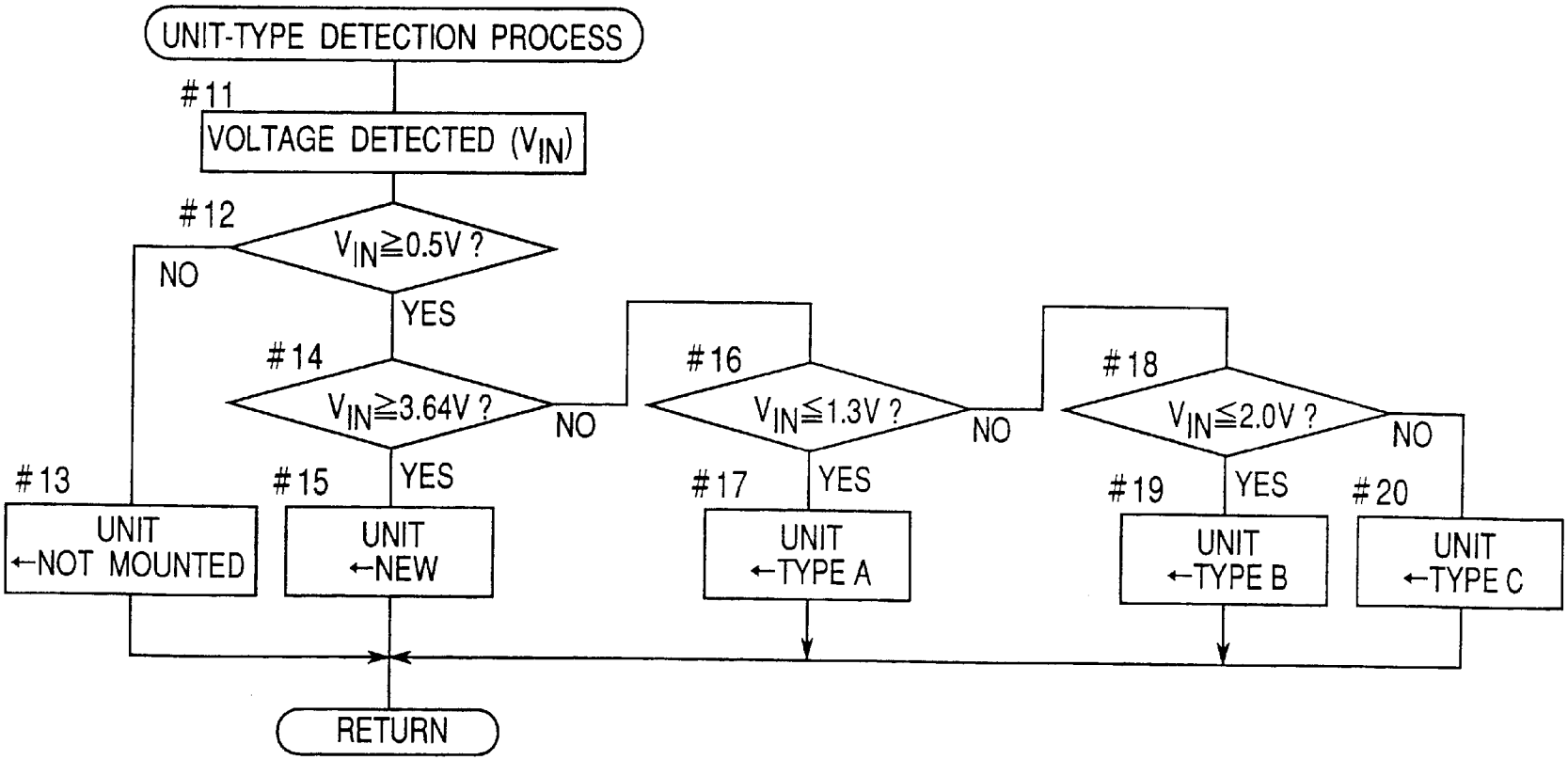
FIG. 13 is another flowchart of a process for determining the type of the unit.

At step #3, as shown in FIG. 13, it is determined the type of the unit mounted in the lower frame portion 38. In this embodiment, prepared are three different types of units; unit A capable of printing for 5,000 sheets, unit B for 10,000 sheets, and unit C for 15,000 sheets. User or operator can choose any one of those units A to C based upon the number of possible printings. Each resistor R1 in the units A to C has a specific resistance which is different from others.

The controller 90 reads voltages $V_{IN}$ at the node 86 detected by the voltmeter 88 at step #11 and then determines at step #12 whether either of the units U is mounted in the lower frame portion 38. When the unit U is not mounted in the lower frame portion 38, since the main and the complementary circuits 72 and 74 remain disconnected, no current will flow in the circuit portion 72. Accordingly, the voltmeter 88 indicates zero-volt.

The controller 90 determines at step #13 whether the detected voltage, i.e., $V_{IN}$ is equal to or more than 0.5 volts. Then, if $V_{IN}$ is less than 0.5 volts, the controller 90 determines that the unit is not mounted in the lower frame portion 38. Contrary to this, if $V_{IN}$ is equal to or more than 0.5 volts, which means that the unit U is mounted in the printer 10, another determination is made at step #14 whether the $V_{IN}$ is equal to or more than 3.64 volts. Note that if the mounted unit is not new; that is, it had been mounted in the printer at least once, the fuse RF is already blown which will be described below. In this instance, $V_{IN}$ will be less than 3.64 volts. On the other hand, if the unit is first mounted in the printer 10, since the fuse RF of this unused unit is not blown yet, $V_{IN}$ will be equal to or more than 3.64 volts. Therefore, if the detected voltage $V_{IN}$ is equal to or more than 3.64 volts, the controller 90 determines at step #15 that the unit U is new.

Due to the differences in resistance of the resistors R1 in the units A to C, an individual voltage will be detected in the voltmeter 88 depending upon the type of the unit now mounted. Therefore, if the detected voltage VIN is less than 3.64 volts, the controller 90 determines at steps #16 and #18 whether the detected voltage $V_{IN}$ is equal to or more than 1.3 volts, more than 1.3 volts but equal to or less than 2.0 volts, or more than 2.0 volts. Accordingly, the controller determines at steps #17, #18 and #19 that the unit A is mounted in the printer 10 if $V_{IN} \leqq 1.3$ volts, the unit B if 1.3 volts$<V_{IN} \leqq 2.0$ volts, and the unit C if 2.0 volts$<V_{IN}$.

Figure 14:
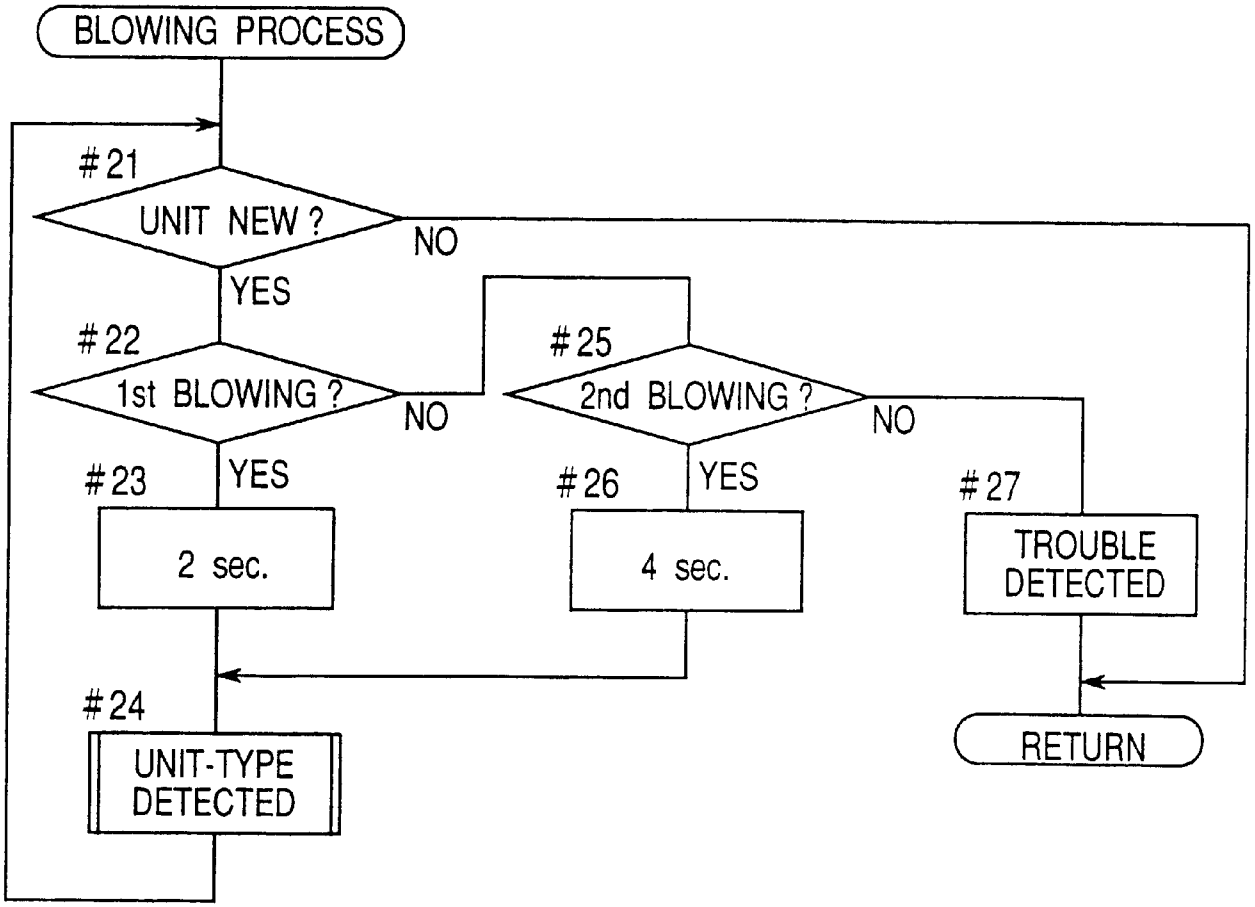
FIG. 14 is a flowchart of a process for blowing the fuse.

In the fusing process at step #4, as shown in FIG. 14, from the determination at step #13 shown in FIG. 13, another determination is made at step #21 whether the unit U mounted in the printer 10 is new. If it is determined that the mounted unit is not new, the program returns to the main flow shown in FIG. 12. On the other hand, if it is determined that the unit is new, the fuse RF is blown in a fusing process.

Figure 11:
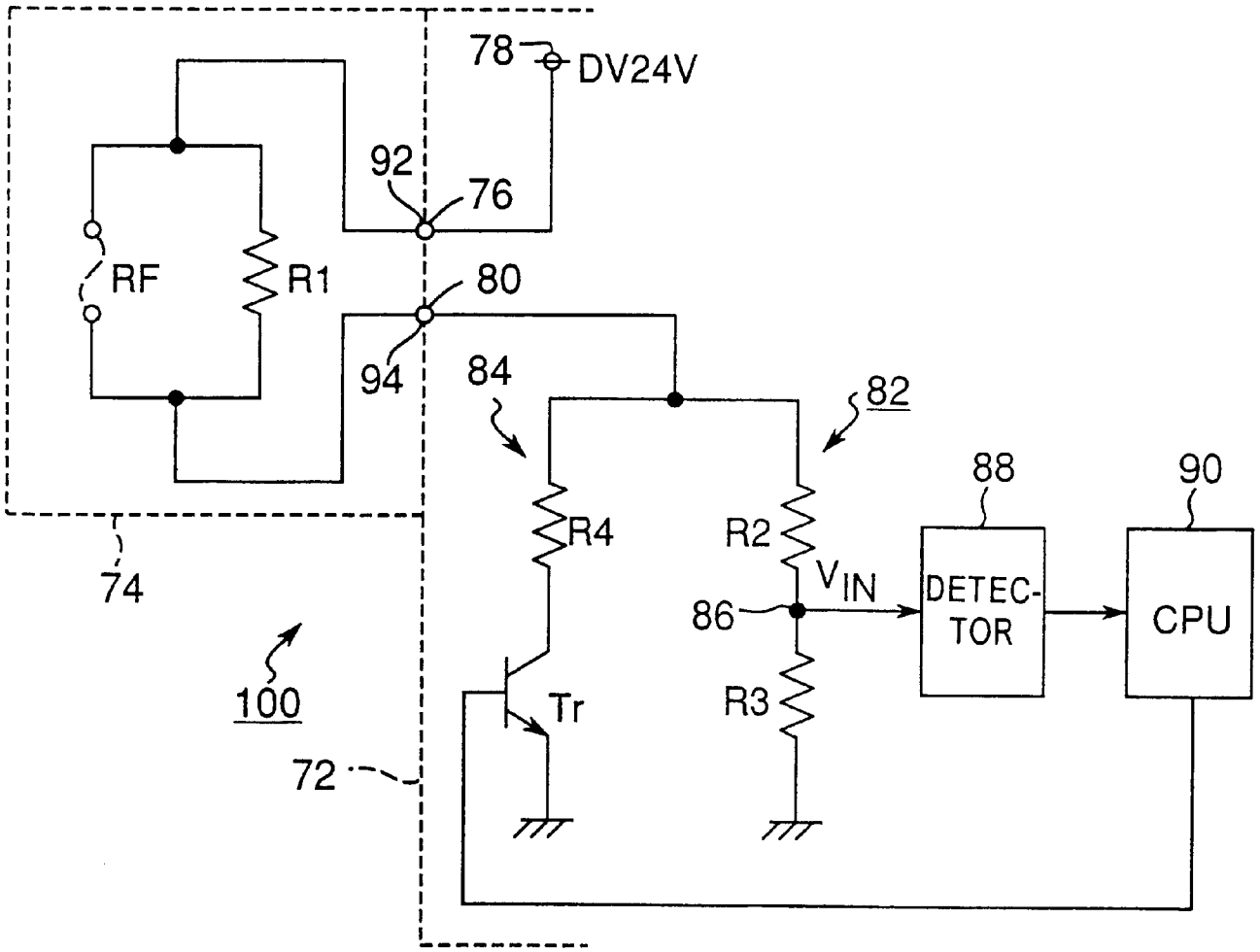
FIG. 11 is a diagram of the unit detecting circuit in which a fuse is blown.

In the fusing process, a determination is made at step #22 whether the subsequent fusing operation which will be performed right after the determination is the first trial. If so, the controller 90 turns on the transistor Tr for two seconds at step #23. This allows an excessive current to flow through the fuse RF, blowing the fuse RF (see FIG. 11.) Then, the controller determines the type of the mounted unit U at step #24.

The two seconds turn-on of the transistor Tr may be insufficient to blow the fuse RF. Therefore, subsequent to the first fusing trial, another determination may be made at steps #24 and #21 whether the unit U is new; that is, the fuse RF has not been blown. If it is determined that the fuse RF is alive, the controller 90 determines at steps # 22 and #25 that subsequent fusing will be the second time trial, not first time trial. Then, the controller 90 allows the transistor Tr to turn on for four seconds for blowing the fuse RF at step #26. Subsequently, another determination is made at steps #24 and #21 that the fuse RF has been blown. If the fuse RF could not be blown in spite of the two times fusing trials, it should be determined that there exists any trouble in the printer 10. Then, the controller 90 performs a trouble-detection for detecting the possible trouble.

In view of this, the detector 100 allows to detect whether not only the unit U is mounted in the printer 10 but also the unit U mounted in the printer 10 is new or unused. Further, the type of the mounted unit U can be detected.

Although the description has been made to the embodiment in which the present invention is applied to the printer, the present invention may be equally applied to other image forming apparatus, such as copy machine facsimile, using disposable or single-use unit.

Also, it should be noted that the present invention is not limited to the electrophotographic image forming apparatus but can be applied to other types of image forming apparatus.

Further, although the detachable unit is not limited to the photosensitive-drum unit or developing unit, it may be other disposable units, such as sheet-feeding unit, charging unit, erasing unit, transferring unit, cleaning unit, and fixing unit.

Furthermore, the photosensitive-drum unit and/or developer unit may include one or more detachable small units and a detector for detecting whether the small unit is mounted in the main unit.

Moreover, the voltage at the node 86 in the circuit portion 72 is detected and, based upon the detected voltage, the fusing process is performed in the previous embodiment. Alternatively, an electric current flowing in the circuit portion 82 may be detected and, using the detected current, the unit detection and fusing processes may be carried out.

Further, although the transistor Tr is used in the circuit portion 84 for blowing the fuse RF, another switching device may be employed instead.

The invention has been fully described in detail with particular reference to certain preferred embodiments thereof, but it will be understood that variations and modifications can be effected within the spirit and scope of the invention.

The disclosure of this application relates to subject matter contained in Japanese Patent Application No. 09-310291, filed on Nov. 12, 1997, which is expressly incorporated herein by reference.

What is claimed is:

1. A detecting system for use in an image forming apparatus, said image forming apparatus being detachably provided with a unit which cooperates with said image forming apparatus in an image formation of said image forming apparatus, wherein said detecting system detects whether said detachable unit is properly mounted in said image forming apparatus, comprising:

a complementary circuit mounted in said detachable unit, said complementary circuit including a fuse and a first resistor connected in parallel with said fuse; and a main circuit mounted in said image forming apparatus, said main circuit including a power source, a first circuit portion, said first circuit portion having a second resistor which is connected with said power source through said first circuit portion when said unit is mounted in said image forming apparatus, a second circuit portion, connected in parallel with said second resistor, said second circuit portion having a third resistor and a switch connected in serial with said third resistor, a detector for detecting a voltage or a current in a portion of said first circuit portion, and a third circuit portion, in response to said voltage or current detected by said detector, for closing said switch to blow said fuse.

2. The system in accordance with said claim 1, wherein a plurality of said units are prepared for said image forming apparatus, in which said units said first resistors have different resistances, and said main circuit further includes means for determining whether which unit is mounted in said image forming apparatus.

3. An image forming unit for use with an image forming apparatus, said image forming apparatus capable of detachably holding one of different types of image forming units, comprising:

a fuse; and a resistor connected in parallel with said fuse, a resistance value of the resistor in any one type of image forming unit being different from the resistance value of the resistor in a different type of image forming unit.

4. The image forming unit in accordance with said claim 3, wherein said fuse is blown in response to a signal transmitted from said image forming apparatus.

5. The image forming unit in accordance with said claim 3, wherein, when a voltage is provided from said image forming apparatus, said image forming unit takes either of first and second conditions, in said first condition said voltage being applied to said fuse and said resistor and in said second condition said voltage being applied only to said resistor.

6. A system for detecting a characteristic of an image forming unit for use with an image forming apparatus, said image forming apparatus capable of detachably holding one of different image forming units, comprising:

a first circuit mounted in said image forming unit, having a fuse and a resistor connected in parallel with said fuse;

a second circuit mounted in said image forming unit including a switch connected in parallel with a resistor means a voltage supply mounted in said image forming apparatus for supplying a voltage to said first and second circuits;

a monitor for monitoring said voltage applied to said resistor means of said second circuit; and a determining device for determining a characteristic of said image forming unit from said voltage monitored by said monitor.

7. The system in accordance with claim 6, wherein said characteristic of said image forming unit is whether said image forming unit is new.

8. The system in accordance with claim 6, wherein said characteristic of said image forming unit is a type thereof.

9. The system in accordance with claim 7, further comprising a fusing device for blowing said fuse when said characteristic indicating that said image forming unit new is detected.

10. The system in accordance with claim 9, wherein said fusing device performs a plurality of blowing processes for blowing said fuse.

11. The system in accordance with claim 10, wherein a time period for blowing said fuse in one blowing process is set to be longer than that in the previous blowing process.

12. The system in accordance with claim 10, wherein said monitor monitors a voltage applied to said resistor means of said second circuit after said blowing of said fuse and, based on said monitored voltage, said type of said image forming unit is determined.

13. An image forming apparatus, comprising:

a holder for detachably holding an image forming unit having a first circuit and a second circuit; and a voltage supply supplying a voltage to said first and second circuits, said first circuit including a fuse and a resistor connected in parallel with said fuse, said second circuit including a monitoring circuit and a determining means, said monitoring circuit including a switch connected in parallel with a resistor means, and a detector for detecting a voltage applied to said resistor means, said determining means determining a characteristic of said image forming unit in said holder from said voltage and applying a control signal to said switch based on said determined characteristic.

14. The image forming apparatus of claim 13, wherein said characteristic to be determined is whether said image forming unit is new.

15. The image forming apparatus of claim 14, wherein said determining means applies a control signal to said switch for blowing said fuse when said image forming unit is determined to be new.

* * * * *